US005540316A

United States Patent [19]

DiPaolo et al.

[11] Patent Number: 5,540,316

[45] Date of Patent: Jul. 30, 1996

[54] COIN CONTROLLED APPARATUS FOR LOCKING SHOPPING CARTS TOGETHER

[75] Inventors: Anthony M. DiPaolo, 19221 Edison Ave., Chesterfield, Mo. 63005; John T. Hood, Chesterfield, Mo.

[73] Assignee: Anthony M. DiPaolo, Chesterfield, Mo.

[21] Appl. No.: 490,837

[22] Filed: Jun. 15, 1995

[51] Int. Cl.[6] ..... G07F 5/02; G07F 17/00

[52] U.S. Cl. ..... 194/212; 194/905

[58] Field of Search ..... 194/205, 212, 194/247, 249, 253, 257, 259, 290, 291, 905

[56] References Cited

U.S. PATENT DOCUMENTS

| | | | |
|---|---|---|---|
| 4,474,280 | 10/1984 | Lenander | 194/247 |
| 4,635,782 | 1/1987 | Wieth et al. | 194/212 |
| 4,691,816 | 9/1987 | Trubiano | 194/212 |
| 4,766,989 | 9/1988 | Maloeuvre et al. | 194/257 |
| 5,040,656 | 8/1991 | DiPaolo et al. | 194/212 |
| 5,121,823 | 6/1992 | Wanzl et al. | 194/253 |
| 5,131,517 | 7/1992 | DiPaolo et al. | 194/257 |
| 5,220,987 | 6/1993 | DiPaolo et al. | 194/212 |
| 5,236,073 | 8/1993 | DiPaolo et al. | 194/212 |

FOREIGN PATENT DOCUMENTS

| | | | |
|---|---|---|---|
| 3900582 | 7/1990 | Germany | 194/905 |
| 3900538 | 7/1990 | Germany | 194/905 |
| 2195804 | 4/1988 | United Kingdom | 194/259 |

*Primary Examiner*—Karen B. Merritt
*Assistant Examiner*—Scott L. Lowe
*Attorney, Agent, or Firm*—Senniger, Powers, Leavitt & Roedel

[57] ABSTRACT

Coin-controlled apparatus for locking shopping carts together in nested series at a cart parking station having coin-controlled mechanism mounted on a cart, e.g. on the handle of the cart, which is adapted for receiving and releasably locking therein a latch bar on a tether which is attached to the next cart in the nested series. Deposit of a coin is required to release the latch bar to free the cart for being wheeled away by the user. The coin is held until the user brings the cart back to a cart parking station, nests it in the end cart at the parking station, and inserts the latch bar which is tethered to the end cart in the mechanism to lock the returned cart to the series and to provide for return of the user's coin. The apparatus has a detent arrangement permitting reduction in its size.

11 Claims, 7 Drawing Sheets

COIN CONTROLLED APPARATUS FOR LOCKING SHOPPING CARTS TOGETHER

BRIEF SUMMARY OF THE INVENTION

This invention relates to coin-controlled apparatus for locking shopping carts together, and more particularly to such apparatus involving improvements upon the apparatus shown in our U.S. Pat. No. 5,040,656 issued Aug. 20, 1991, U.S. Pat. No. 5,131,517 issued Jul. 21, 1992 and U.S. Pat. No. 5,220,987 issued Jun. 22, 1993, each entitled Coin-Controlled Apparatus for Locking Shopping Carts Together, these patents being incorporated herein by reference.

The invention is generally directed toward providing an improved construction for the apparatus shown in our aforesaid U.S. patents enabling it to be made in a substantially smaller size so as to take up less room and to have a better appearance on the handle of a shopping cart; the provision of such a construction enabling savings in material, and easier assembly of parts for economy in production; and the provision of such a construction which is more tamper-proof, including increased resistance to forcing in the coin slide thereof.

In general a coin-controlled apparatus of this invention for locking shopping carts together in nested series comprises coin-controlled mechanism which is mounted on a cart and which is adapted for receiving and releasably locking therein a bar on a tether attached to the next cart in the series. The coin-controlled mechanism comprises an elongate body having a top, bottom, sides and rearward and forward ends, with an elongate slideway for a coin slide extending therein from the rearward end thereof toward the forward end, and adapted for being mounted in a generally horizontal position on a shopping cart. The body is of two-part construction comprising a lower part having an elongate bottom wall, upwardly extending side walls, and a forward end wall, and an upper part having an elongate top, downwardly extending side walls abutting on the side walls of the lower part and a forward end wall abutting the forward end wall of the lower part. The top of the upper part of the body has a top formation with an elongate detent-receiving recess therein extending forward lengthwise of the body from adjacent the rearward end of the body. The recess opens downward to the space between the side walls of said upper part. A coin slide having a forward and a rearward portion is slidable in the slideway between an outer rearward position and forward position, the mechanism having means for limiting rearward movement of the slide and determining its rearward position. The rearward portion of the coin slide has a relatively deep narrow recess for holding a coin on edge therein with the coin projecting up out of said coin-holding recess, the latter being located outwardly of the rearward end of the body when the slide is in its rearward position for deposit of a coin therein and for retrieval of a coin therefrom and being located within the body when the slide is pushed inward and forward. Spring means biases the coin slide outwardly to its said rearward position. Means is provided for limiting the inward movement of the slide in the absence of a coin in the coin-holding recess but allowing inward movement of the slide to forward position inward of the limit as long as a coin is placed in the coin-holding recess. The body has a hole at one side for insertion of a bar. Means is provided for latching the slide in its said forward position and latching the inserted bar in said body, the slide being released from said forward position for return to its said rearward position by the bar upon insertion of the bar in said body. The means for limiting the inward movement of the slide in the absence of a coin comprises stop-engaging means at the top of the slide adjacent and forward of the coin-holding recess, a detent for the coin slide extending lengthwise of the body in said detent-receiving recess, the detent having means at one end thereof constituting its forward end pivotally mounting the detent for swinging movement in a generally vertical plane about an axis at said forward end of the detent between a lowered position and a raised position, the lowered position being determined by engagement of the detent adjacent its rearward end with the top of the slide, the detent having a stop at the bottom thereof between its rearward and forward ends engageable by the stop-engaging means when the detent is in its lowered position and the slide is pushed in without a coin in said coin-receiving recess to limit the inward movement of the slide. The upper portion of a coin in the recess is engageable with the detent adjacent the rearward end of the detent when the slide is pushed inward and forward in the body to raise the detent and thereby to raise said stop out of the way of said stop-engaging means to allow the slide to be pushed in to forward position forward of the limit imposed by the stop.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
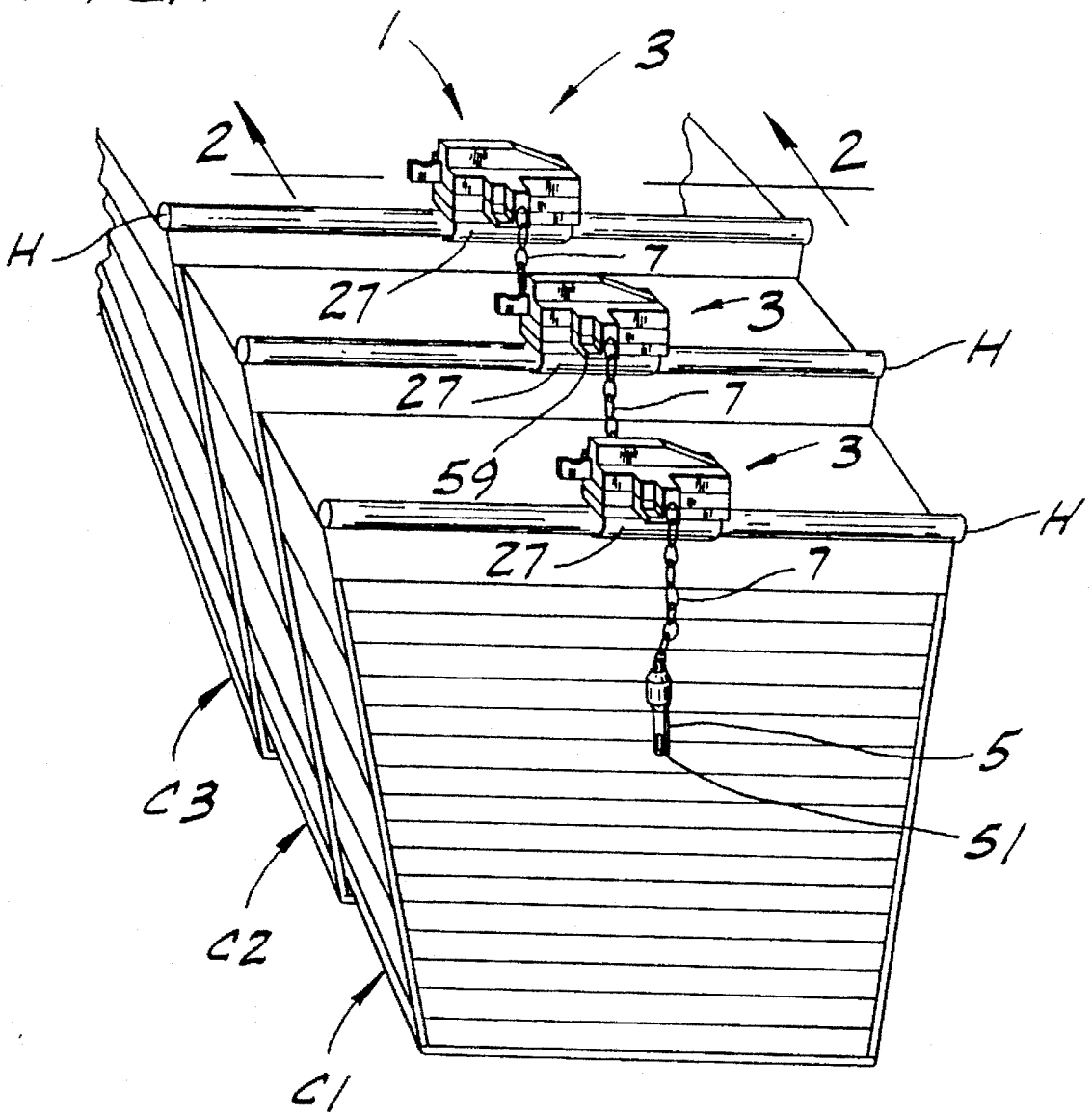
FIG. 1 is a generally perspective view showing a series of nested shopping carts locked together by a coin-controlled apparatus of this invention, the cart wheels being omitted.

Referring first to FIG. 1 of the drawings, there is shown a series of shopping carts disposed in nested relation as at a cart parking station in the parking lot of a supermarket. Three such carts are shown, designated C1, C2 and C3, C1 being the end cart of the series nested in C2, and C2 being nested in C3. The handle of each cart is designated H; the cart wheels are omitted. At 1 is generally indicated coin-controlled apparatus of this invention for locking the carts together in the nested series, this apparatus comprising improved coin-controlled mechanism designated in its entirety by the reference numeral 3 mounted on each cart, more particularly on the handle of the cart, each mechanism being adapted for receiving and releasably locking therein (under coin control) a latch bar 5 on a tether 7, preferably a chain, which is attached to the next cart (more particularly attached to the coin-controlled mechanism 3 on the next cart in the series). As illustrated in FIG. 1, similar to FIG. 1 of our aforesaid U.S. patents, cart C1 is locked to cart C2 by the latch bar 5 on the chain 7 extending from the mechanism 3 on cart C2 and cart C2 is locked to cart C3 by the latch bar 5 on the chain 7 extending from the mechanism 3 on cart C3. The chain 7 which is secured to the mechanism 3 on cart C1 is shown as hanging loose, awaiting insertion of the latch bar 5 on that chain in the mechanism 3 on the next cart which is wheeled up to be nested in cart C1. The size and appearance of the improved coin mechanism 3 of this invention as shown in FIG. 1 herein are to be contrasted with the size and appearance of the coin mechanism 3 of our aforesaid prior patents as shown in FIG. 1 of each of the latter.

Each coin mechanism 3 of this invention comprises an elongate body generally designated 9 having a top 11, bottom 13, sides 15 and 17 and ends 19 and 21, end 19 being referred to as the rearward end and end 21 being referred to as the forward end. The body is made to have an elongate opening 23 therein extending from its rearward end 19, where it is open, toward but terminating short of its forward end 21, where it is closed. This opening 23 constitutes a slideway for a coin slide 25 which extends slidably therein from the rearward end 19 of the body toward the forward end 21. The body 9 is adapted for being mounted in a generally horizontal position on a shopping cart, more particularly in such position above the handle H of the cart extending lengthwise of the handle by having mounting means such as generally indicated at 27 in FIG. 1 on the bottom thereof.

The elongate body 9 is of two-part construction comprising a lower part 29 (see FIGS. 10–13) generally of channel shape in cross section having an elongate bottom wall or web 31 (the bottom of which is the bottom 13 of the body), upwardly extending side walls 33 and 35 and a forward end wall 37, and an upper part 39 (see FIGS. 6–9) generally of inverted channel shape in cross section having an elongate top 41, downwardly extending side walls 43 and 45 and a forward end wall 47. The side and end walls have a height one-half the full body height. The two parts are assembled with the downwardly extending side walls of the upper part abutting the upwardly extending side walls of the lower part, and with the forward end wall of the upper part mating with the forward end wall of the lower part, the two parts being secured together as by screws as indicated at 49 in FIG. 5A. Each of parts 29 and 39 is preferably molded of plastic.

Figure 16:
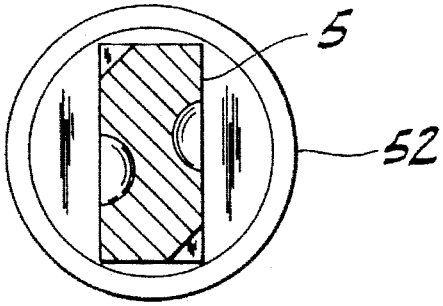
FIG. 16 is a transverse section generally on line 16—16 of FIG. 5A.

The latch bar 5 is an elongate bar which may have the cross section illustrated in FIG. 16 and having a rectangular hole 51 (see FIG. 1) therein adjacent one end thereof, which may be referred to as its inner end, extending through the bar from one broad side thereof to the other. A hand grip 52 is provided adjacent the outer end of the bar. The portion of the bar extending out of the hand grip 52 is about one and three-quarters inches long, for example. The body 9 is formed in its side 15 (constituted by walls 33 and 43 of parts 29 and 39), which is the side of the body which faces forward relative to the cart as the mechanism 3 is mounted on the handle of the cart, with a hole 53 for insertion of the latch bar. This hole is formed by a slot 55 in the upwardly extending side wall 33 of the lower part 29 of the body and an aligned slot 57 in the downwardly extending side wall 43 of the upper part 39 of the body, each slot forming half the hole. The body is also formed with a latch housing generally designated 59 on the side opposite the hole 53 extending laterally outwardly therefrom with a recess 61 in this housing and a second hole 63 transversely aligned with the hole 53 extending between the slideway 23 and the recess 61 in said latch housing 59. The latter comprises a lower part 65 on the outside of the lower part 29 of the body and an upper part 67 on the outside of the upper part 39 of the body. The lower part 65 has a bottom 69, and upwardly extending side walls 71 and 73 and an end wall 75, and the upper part 67 has a top 77, downwardly extending side walls 79 and 81 and an end wall 83, these walls all having a height one-half the body height and registering to form the housing 59 with the recess 61 therein. The hole 63 is narrower than the recess 61 and is located centrally at the end of the recess toward the slideway 23, defining shoulders 85 at the end of the recess toward the slideway 23. It is formed by a slot 87 in the upwardly extending side wall 35 of the lower part 29 of the body 9 and an aligned slot 89 in the downwardly extending side wall 45 of the upper part 39 of the body. End walls 75 and 83 meet to form a closed outer end for the housing 59. Provision is made for attaching the chain 7 to the body 9 alongside latch housing 59 as indicated at 60.

The top 41 of the upper part of the body 9 has a top formation 91, constituting a detent housing, having an elongate detent-receiving recess 93 therein. This recess is narrower than the distance D (see FIG. 7) between the inside faces of the side walls 43 and 45 of the upper part 39 of the body 9 and extends forward lengthwise of the body from adjacent the rearward end 19 of the body, being centered with respect to the side walls 43 and 45 of the upper part 39 of the body 9 and opening downward as indicated at 95 to the space 97 between the side walls 43 and 45 of the upper part 39. With the recess 93 narrower than the distance D and centered between the inside faces of the side walls 43 and 45, the upper part 39 of the body 9 has downwardly facing shoulders 99 on the inside of and at the top of the side walls 43 and 45 thereof. These shoulders have downwardly opening pin-receiving recesses 101 adjacent the holes 53 and 63.

The detent housing 91 is preferably configured to have a rearward horizontal top portion 91*a* extending from the rearward end of the body 9 for about one-third the length of the body and a forward inclined portion 91*b* slanting down toward the forward end of the body. In the alternative, it could be configured like housing 105 shown in our aforesaid U.S. patents. Shoulders 99 extend generally the full length of the body.

Figure 2:
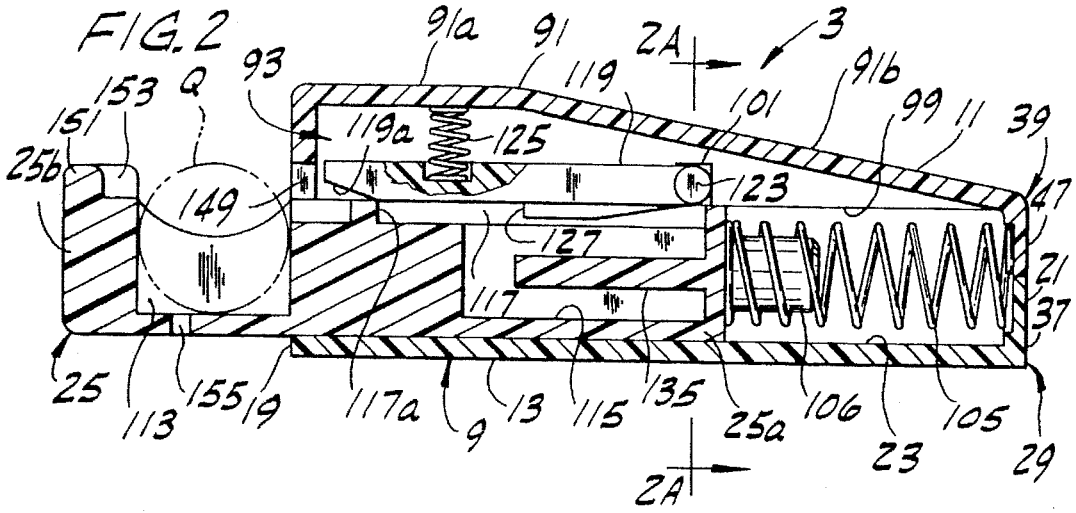
FIG. 2 is vertical longitudinal section of a coin-controlled mechanism of the apparatus, generally on line 2—2 of FIG. 1, showing the coin slide of the mechanism in a rearward position (its outer or retracted position) with respect to the body of the mechanism, in which it is slidable.
Figure 2A:
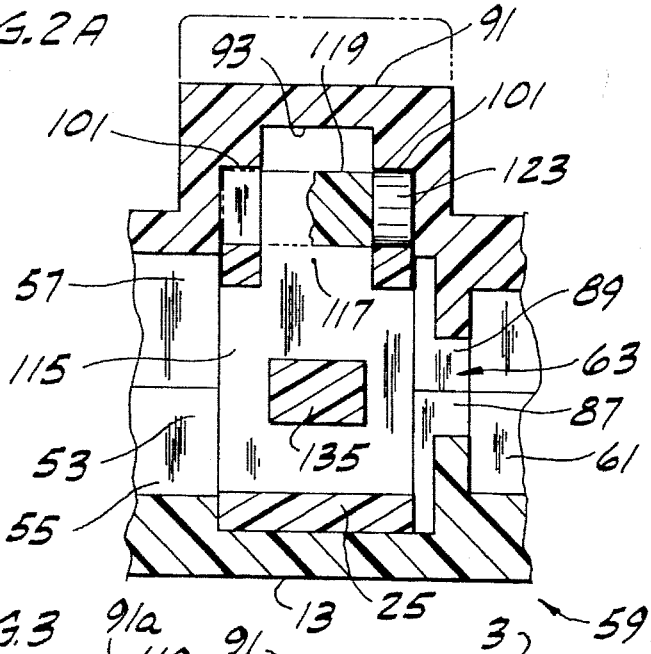
FIG. 2A is a vertical transverse section generally on line 2A—2A of FIG. 2.
Figure 3:
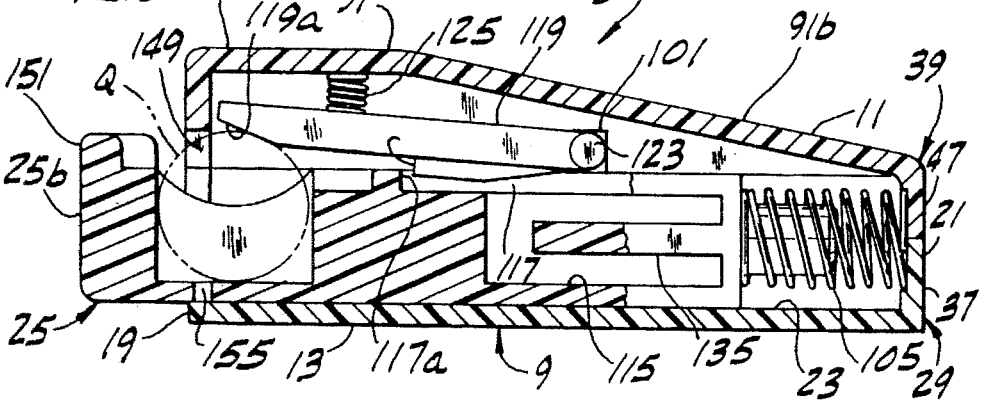
FIG. 3 is a view similar to FIG. 2 showing the coin slide in an intermediate position.
Figure 4:
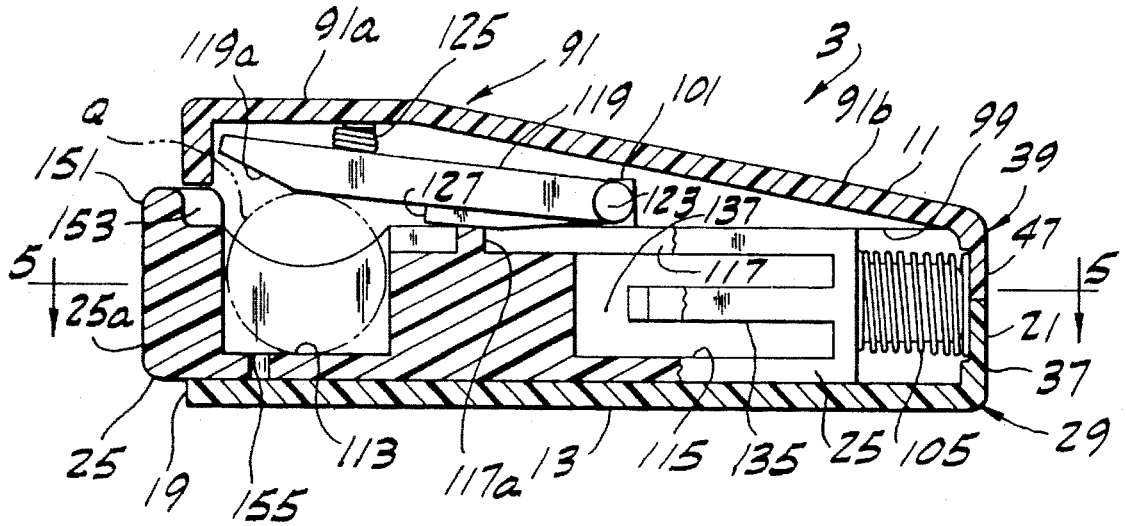
FIG. 4 is a view similar to FIGS. 2 and 3 showing the coin slide in its forward (inner) position.
Figure 5A:
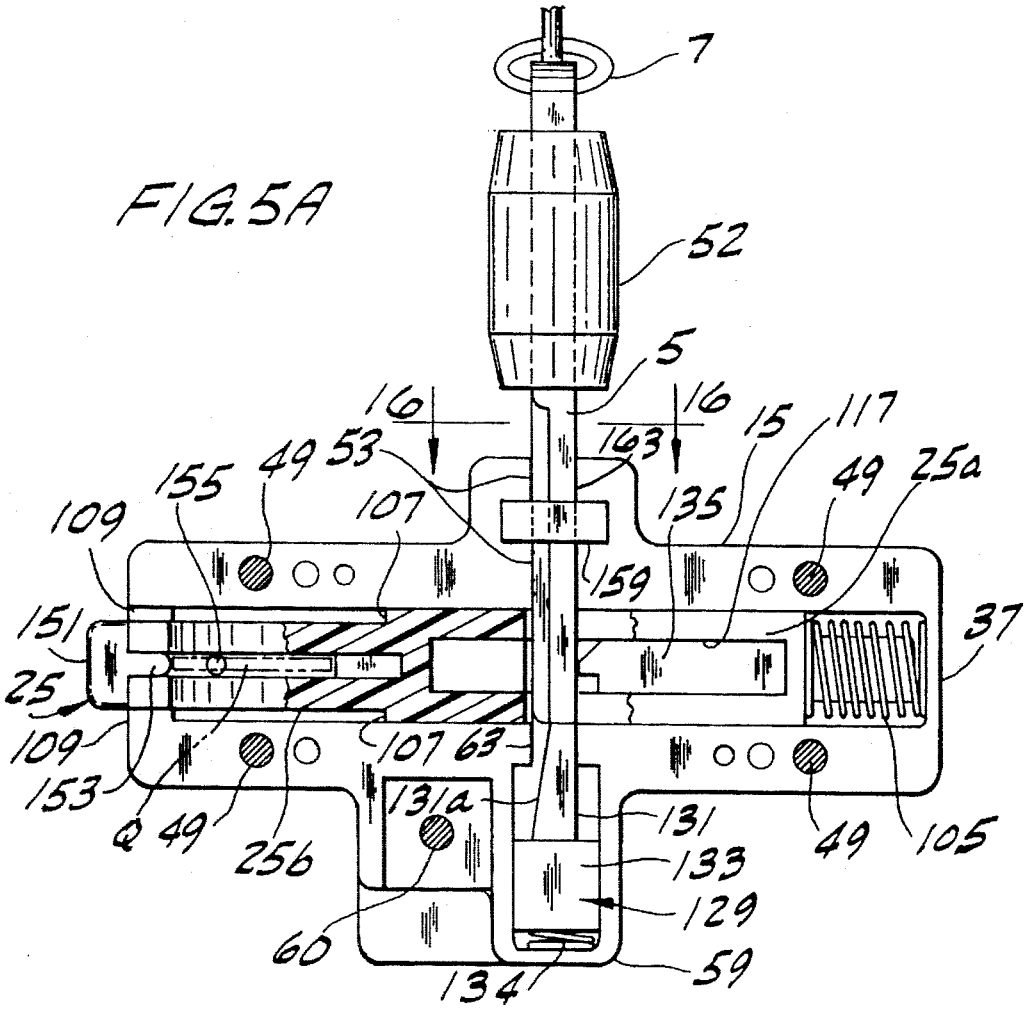
FIG. 5A is a horizontal longitudinal section generally on line 5—5 of FIG. 4 showing the latch bar of the apparatus in position extending across the slideway in the body of the mechanism just before it is pushed out by the slide latch of the apparatus, the slide latch being shown in its retracted position.
Figure 5B:
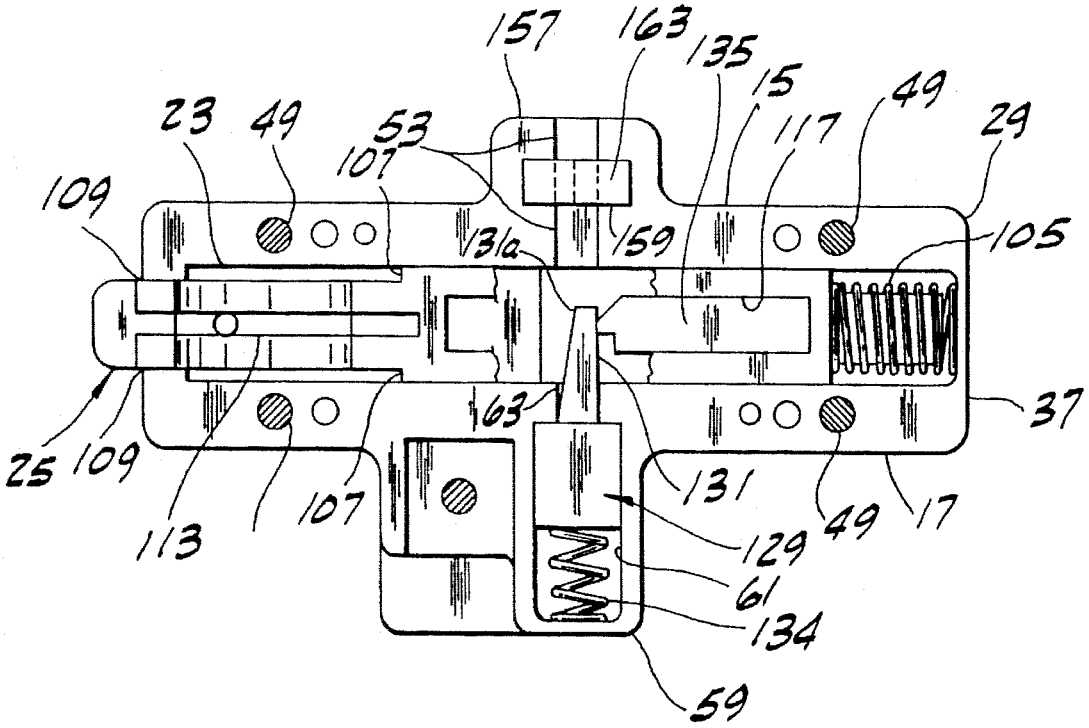
FIG. 5B is a view similar to FIG. 5A showing the slide latch in its extended position, after having pushed out the latch bar.

The coin slide 25 has a forward (inner) portion indicated at 25*a* and a rearward (outer) portion 25*b*, "forward" being in reference to the direction in which the slide is pushed in, and "rearward" being the reverse. A coil compression spring 105 accommodated in the slideway 23 toward its forward end acts from the closed end of the slideway at 21 against the forward end of the slide 25 to bias it rearward. The spring surrounds a spring centering pin 106 at the forward end of the slide. The rearward and forward portions 25*a* and 25*b* of the slide are each generally rectangular in transverse cross section with the rearward portion of reduced width relative to the forward portion thereby forming rearwardly facing shoulders 107 at opposite sides of the slide. These shoulders act in conjunction with flanges such as indicated at 109 extending laterally inwardly at the rearward ends of the side walls of the lower part 29 and flanges such as indicated at 111 extending laterally inwardly at the rearward end of the upper part as means for limiting the rearward movement of the slide and determining its stated rearward position. The rearward portion 25*b* of the slide 25 has a relatively deep narrow recess or pocket 113 for holding a coin, more particularly a U.S. quarter Q, on edge therein with the coin projecting up out of the recess as appears in FIGS. 2–4. The coin recess 113 is located outwardly of the rearward end of the body 9 when the slide is in its rearward position of FIG. 2 for deposit or insertion of a coin in the recess and for retrieval of a coin from the recess, and is located within the body when the slide is pushed inward and forward to the forward position in which it is shown in FIGS. 4 and 5A and 5B.

The coin slide 25 has an elongate slot 115 extending lengthwise thereof and extending therethrough from one side to the other in the forward (inner) portion 25*a* thereof, and an elongate slot 117 in the top thereof extending lengthwise from a point forward of and adjacent the rearward end of the forward portion 25*a* to a point adjacent the forward end of said forward portion. A detent 119 acts in conjunction with the slot 117 as means for limiting the inward movement of the slide in the absence of a coin in the coin-holding recess but allows inward movement of the slide to the stated forward position as long as a coin is placed in the coin-holding recess 113. This detent 119 has at one end thereof constituting its forward end pin means generally designated 121, the detent preferably being molded of plastic with the pin means formed integrally therewith as pins 123 extending laterally outwardly of the detent at its forward end. The pins 123 are seated in the pin-receiving recesses 101 in the shoulders 99 of the upper part 39 of the body 9, the detent 119 thereby being pivotally mounted for swinging movement in a generally vertical plane about the axis of the pins between the lowered position in which it appears in FIG. 2 and the raised position in which it appears in FIG. 4. The detent is slightly narrower than the width of the detent recess 93 and is swingable up and down in this recess. It is biased to swing downwardly to its lowered position by a spring 125 interposed between the top portion 91*a* of the detent housing 91 and the top of the detent, its lowered position being determined by the engagement of the detent adjacent its rearward end with the top of the slide, as appears in FIG. 2. The pins 111 are retained (held up) in the recesses 101 by the slide 25. The detent 119 is made with a rearwardly facing step 127 on its bottom between its rearward and forward ends constituting a stop extending down into the slot 117 in the top of the slide when the detent is in its lowered position for engagement with the rearward end 117*a* of this slot when the slide is pushed in without a coin in the coin-receiving recess 113 to limit the inward movement of the slide, preventing it from being pushed all the way in to its FIG. 4 forward position. Thus, the rearward end 117*a* of the slot 117 constitutes stop-engaging means engageable by the stop 127.

At 129 is indicated a latch for latching the slide 25 in its said forward position to hold a coin in the recess 113 against retrieval as will appear. This latch is slidable in the recess 61 in the latch housing 59 (the side housing on the body 9) and in the hole 53, being of T-shape in plan having a stem 131 slidable in the hole 63 and a head 133 slidable in the recess 61, between a laterally retracted position clear of the slideway 23 wherein the stem 131 is back in the hole 63 (see FIG. 5A) and a slide-latching position wherein the stem 131 extends into and across the slideway 23 (see FIG. 5B). The stem 131 has a chamfer 131*a* similar to the chamfer 140 of the latch shown in our aforesaid U.S. Pat. No. 5,220,987. It is biased by a coil compression spring 134 accommodated in the recess 61 between the outer end of the recess and the head 133 toward its slide-latching position. A tongue 135 for entry in the hole 51 in the latch bar 5 for locking the latch bar in the body 9 extends rearward from the forward end of the slot 115 in the slide 25 toward but terminating short of the rearward end of the slot 115 to provide a space indicated at 137 for passage of the latch bar therethrough. The tongue 135 has a tip 139 of reduced width at its rearward end defining a recess 141 at said rearward end similar to the reduced tip 132 for the tongue and recess 134 shown in our aforesaid U.S. Pat. No. 5,220,787.

Each coin mechanism 3 has the respective latch bar chain 7 suitably attached securely at the other end of the chain from the latch bar 5 to the lateral housing 59 of the mechanism. The coin mechanism is mounted on the handle of the cart with the housing 59 extending rearward with respect to the cart; thus as to the cart C1 as shown in FIG. 1, the chain 7 with the latch bar 5 thereon hangs down at the rear end of the cart in position where it is readily accessible to the user. Also as shown in FIG. 1, the coin slides 25 of the mechanisms on each of the three carts are in their rearward (outer) positions wherein the coin recesses 113 therein are accessible for dropping in a coin. The latch bar 5 on the chain 7 attached to cart C2 is locked in the mechanism C1 on cart C1, and the latch 5 on the chain 7 attached to cart C3 is locked in the mechanism on carts C1 and C2 as results from the tongues 135 of the coin slides 25 of these mechanisms extending through the holes 51 in the latch bars 5, thereby pinning the latch bars in the bodies 9 of the respective mechanisms.

To free cart C1 for being wheeled into the supermarket (or other establishment), the user drops a coin (a U.S. quarter Q as herein described) into the recess 113 in the rearward (outer) portion 25*a* of the coin slide 25 of the mechanism 3 on cart C1 and pushes the slide in all the way to its stated forward position, i.e. the position in which it is shown in FIGS. 4 and 5A. This is enabled by reason of the upper portion of the coin engaging the detent 119 adjacent its rearward end, which is beveled as indicated at 119*a*, and camming the detent upward so that the stop 127 clears the rearward end 117*a* of the slot 117 in the top of the slide. When the slide is pushed in to its forward position, the tongue 135 is withdrawn from the hole 51 in the latch bar 5 on chain 7 which extends from cart C2 thereby unlocking the latch bar and freeing it for removal from the body of the mechanism on cart C1. Under the bias of spring 134, the slide latch 129 pushes the latch bar 5 in the direction for removal from the body 9 and moves into the space 137 rearward of the rearward end of the tongue 135, thereby assuming a slide-locking position wherein it is engaged by the tip of the tongue to lock the slide 25 in its said forward (inner) position and thereby hold the coin which is in the recess 113 inaccessible within the body. The user is enabled to obtain return of the coin, however, by returning the cart to the parking station where it was obtained, (or another parking station) and inserting the latch bar 5 on the chain extending from the end cart of the series at the station into the hole 53 and pushing it in against the slide latch 129 and through the space 137, thereby retracting the slide latch 129 to enable the slide 25 to be pushed forward by the spring 105, and the tongue 135 to pass through the hole 51 in the latch bar 5 to lock the returned cart to the series of carts.

The mounting means 27 for the body 9 may be of any suitable construction for mounting the body in a generally horizontal position on top of the handle H of a cart C. Thus, it may for example comprise an upper part which is secured to the bottom of the body by the screws 49, having a groove lengthwise thereof for fitting on the handle, and a lower mating part attached to the upper part by tamper-proof screws, the two parts acting as a clamp for clanging the body on the handle.

The detent housing 91 has side walls indicated at 143 and 145 and a rearward end wall indicated at 147. The latter extends down to the level of the shoulders 99 having a vertical slot 149 extending up from its lower edge for passage of the upper part of the coin seated in the coin recess 113. The coin slide 25 has an upwardly extending knob formation 151 at its rearward end having a forwardly extending web 153 which slides into the slot 149 when the slide is pushed all the way in, access to the interior of the body thereby being blocked to avoid picking the lock when the slide is in its forward position with a quarter in the body. The slide is provided with a drain hole 155 to avoid collection of rainwater in the recess 113.

It will be observed that with the detent 119 pivoted as shown herein at its forward end and extending rearward from its pivot axis, the length of that portion of the stroke of the slide required to raise the detent to its slide-clearing position is substantially less than that of the mechanism shown in our aforesaid U.S. patents, thus enabling substantial reduction in overall length of the apparatus. For example, it is possible to construct the body 9 of the present apparatus with an overall length of 3¾ inches, as distinguished from an overall length of 6 inches for the body 9 of a commercial version of the prior application shown in our aforesaid U.S. patents, with the slide 25, in its rearward position, projecting 1½ inches out of the rearward end of the body. It is to be further observed that with the detent 119 arranged as shown, any attempt to force the slide 25 in without a coin in the coin recess 113 results in a force vector on the detent 119 tending to swing it down and thus lock it more firmly against release. Finally, assembly of the mechanism is simplified by having the pins 123 on the detent seated in the recesses 101 in the shoulders and held therein by the slide 25.

Figure 19:
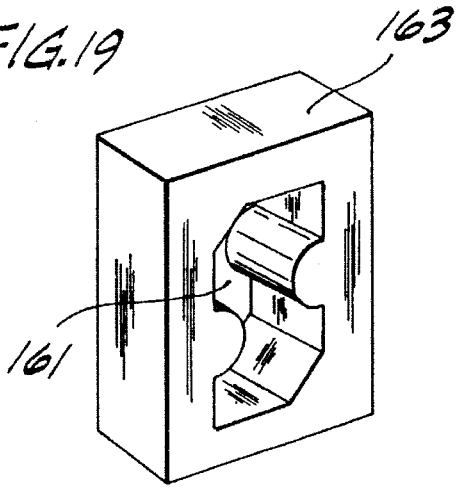
FIG. 19 is a view of an insert which may be used in the mechanism.
Figure 6:
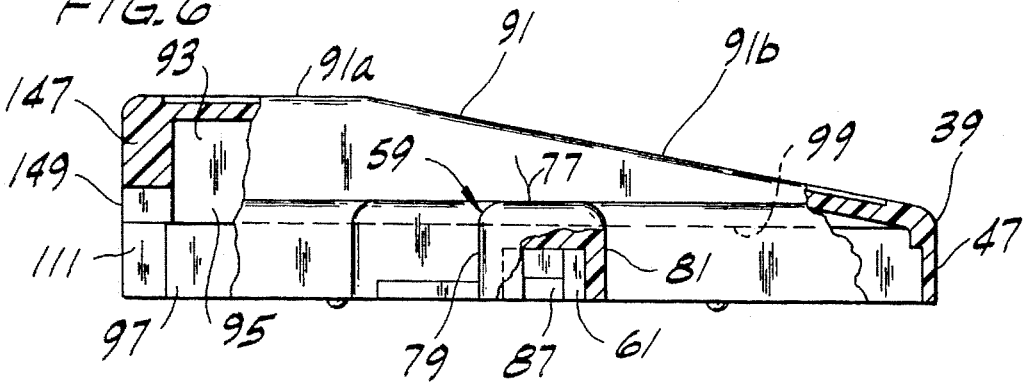
FIG. 6 is a view in elevation of one side of the upper part of the body of the mechanism, with parts broken away and shown in section.
Figure 7:
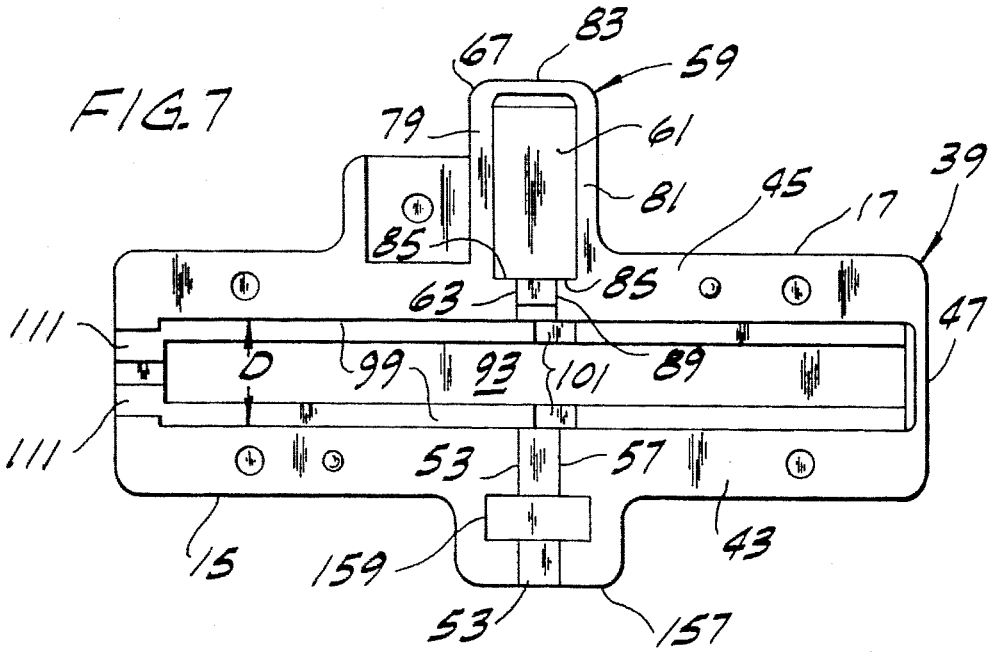
FIG. 7 is a bottom plan of the upper part.
Figure 7A:
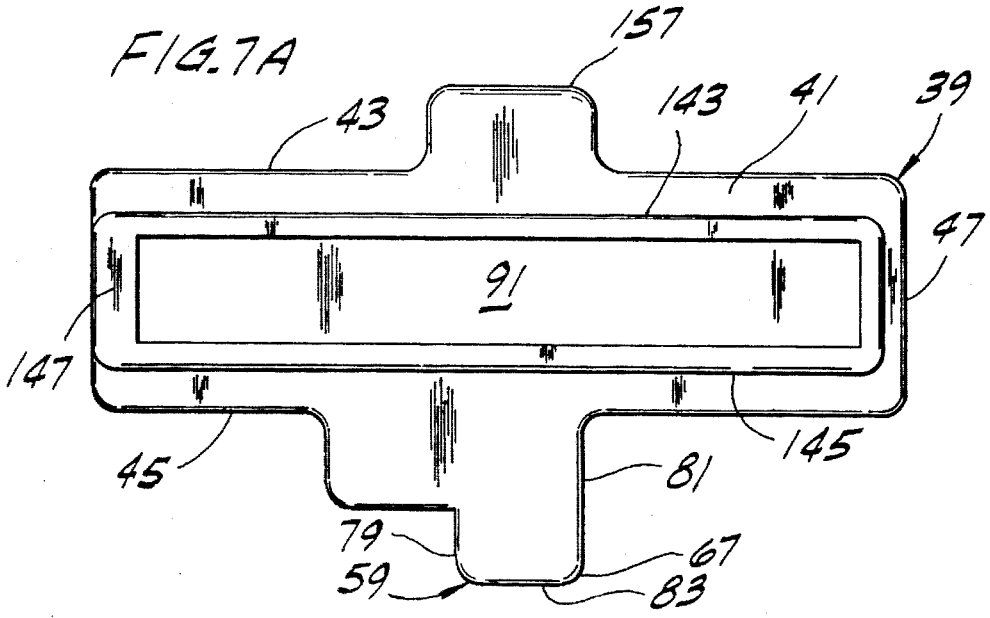
FIG. 7A is a top plan of the upper part.
Figure 8:
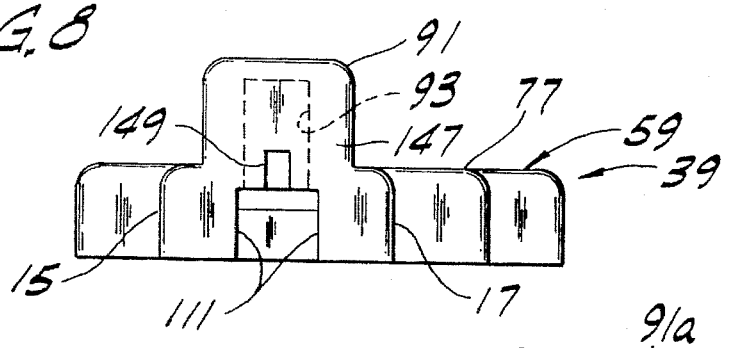
FIG. 8 is a view of the upper part from its left end.
Figure 9:
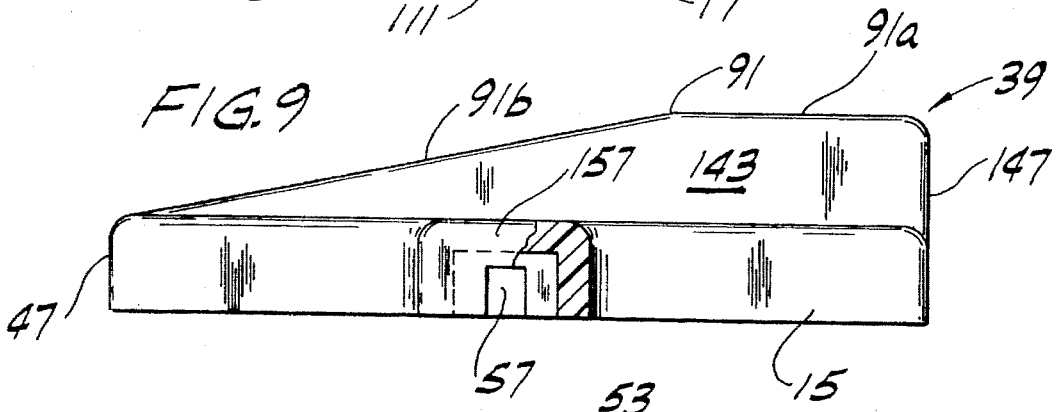
FIG. 9 is a view in elevation of the other side of the upper part, partly broken away and shown in section.
Figure 10:
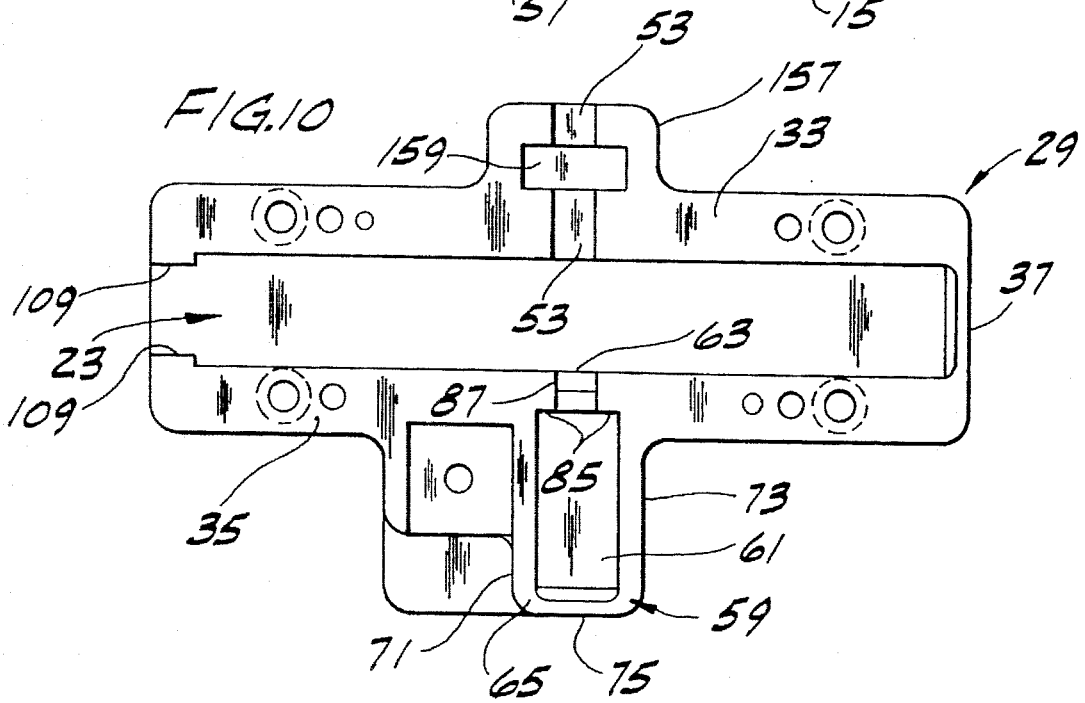
FIG. 10 is a top plan of the lower part of the body.
Figure 11:
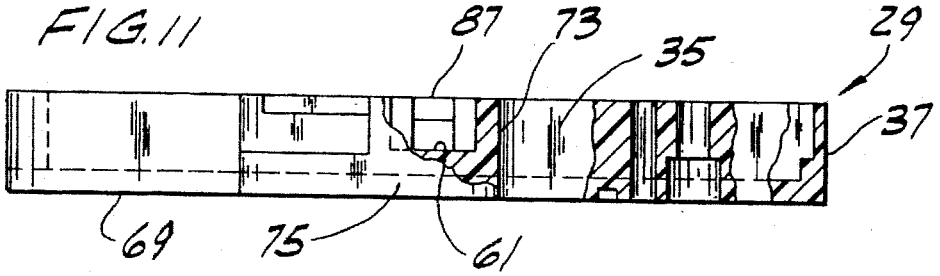
FIG. 11 is a view in elevation of one side of the lower part, with parts broken away and shown in section.
Figure 11A:
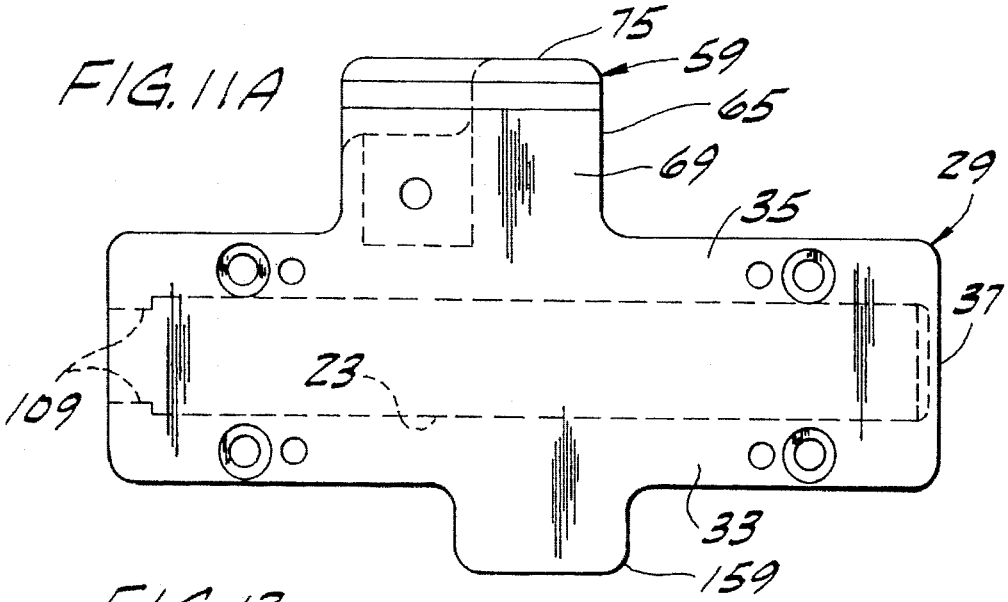
FIG. 11A is a bottom plan of the lower part of the body.
Figure 12:
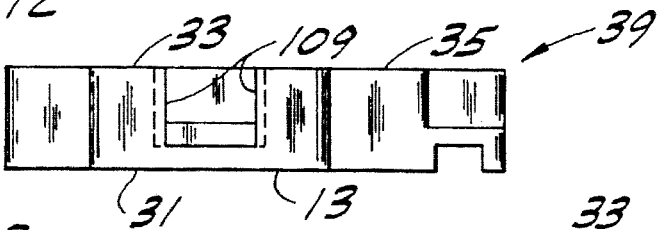
FIG. 12 is a view of the lower part from its right end.
Figure 13:
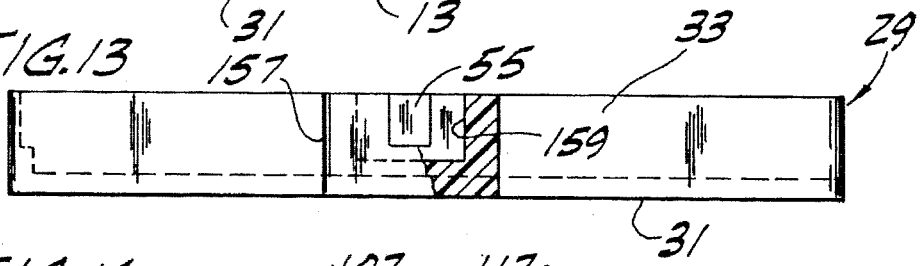
FIG. 13 is a view in elevation of the other side of the lower part, partly broken away and shown in section.
Figure 14:
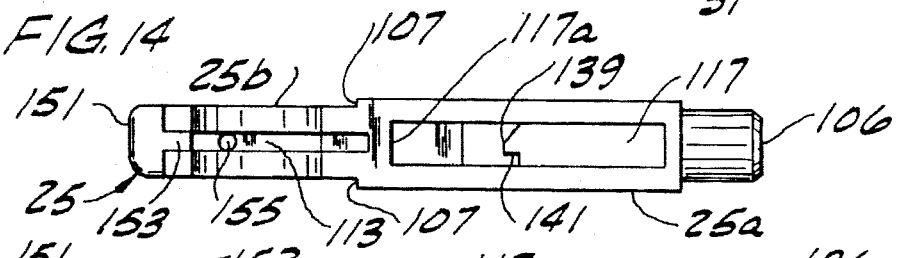
FIG. 14 is a top plan of the coin slide per se.
Figure 15:
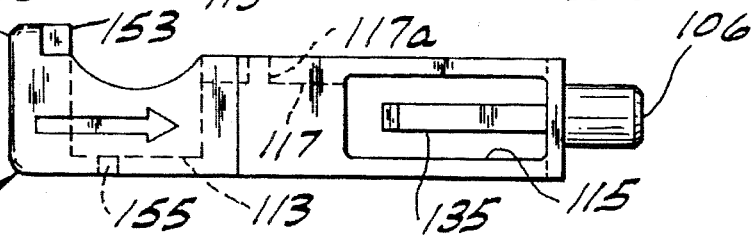
FIG. 15 is a view in elevation of one side of the coin slide.
Figure 17:
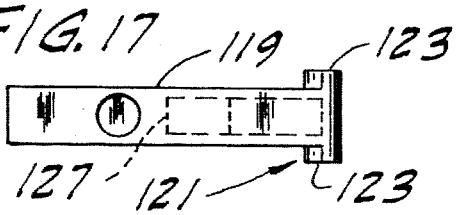
FIG. 17 is a top plan of the detent of the mechanism.
Figure 18:
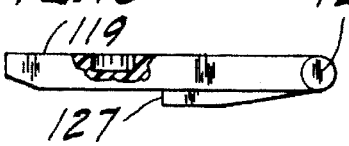
FIG. 18 is a side elevation of the detent.

The hole 53 extends through a recess 157 in a housing 159 on the side of the body 9 opposite the latch housing 59. The bar 5, which may also be referred to as a key, is inserted through a keyhole-shaped opening 161 in a keyhole insert 163 (FIG. 19) which is removably retained in the recess. Different inserts may be used with keyholes 161 of different shape with bars or keys 5 of different cross-section corresponding to the shape of the keyhole to accommodate the mechanism 3 to different supermarkets (or other establishments). The housing 159 is formed in part on the lower part 29 and in part on the upper part 39 of the body 9.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A coin-controlled mechanism for locking shopping carts together in nested series which is mounted on a cart and which is adapted for receiving and releasably locking therein a bar on a tether attached to a next cart in the series; said mechanism comprising:

an elongate body having a top, bottom, sides and rearward and forward ends, with an elongate slideway for a coin slide extending therein from the rearward end thereof toward the forward end, said body being adapted for being mounted in a generally horizontal position on a shopping cart;

said body being of two-part construction comprising a lower part having an elongate bottom wall, upwardly extending side walls, and a forward end wall, and an upper part having an elongate top, downwardly extending side walls abutting the side walls of the lower part and a forward end wall abutting the forward end wall of the lower part, the top of the upper part of the body having a top formation with an elongate detent-receiving recess therein extending forward lengthwise of the body from adjacent the rearward end of the body, said recess opening downward to the space between the side walls of said upper part;

a coin slide having a forward and a rearward portion slidable in the slideway between an outer rearward position and a forward position;

means for limiting rearward movement of the slide and determining its rearward position;

the rearward portion of the coin slide having a relatively deep narrow recess for holding a coin on edge therein with the coin projecting up out of said coin-holding recess, the coin-holding recess being located outwardly of the rearward end of the body when the slide is in its rearward position for deposit of a coin therein and for retrieval of a coin therefrom and being located within the body when the slide is pushed forward;

spring means biasing the coin slide outwardly to its said rearward position;

means for limiting the inward movement of the slide in the absence of a coin in the coin-holding recess but allowing inward movement of the slide to the forward position inward of the limit as long as a coin is placed in the coin-holding recess;

the body having a hole at one side for insertion of a bar;

and means for latching the slide in its said forward position and latching the inserted bar in said body, the slide being released from said forward position for return to its said rearward position by the bar upon insertion of the bar in said body;

characterized in that said coin slide has a top, and in that said means for limiting the inward movement of the slide in the absence of a coin comprises stop-engaging means at the top of the slide adjacent and forward of the coin-holding recess, a detent for the coin slide extending lengthwise of the body in said detent-receiving recess, said detent having means at one end thereof constituting its forward end, namely its end toward the forward end wall of the upper part of said body, pivotally mounting the detent for swinging movement in a generally vertical plane about an axis at said forward end of the detent between a lowered position and a raised position, the lowered position being determined by engagement of the detent adjacent its rearward end with the top of the slide, said detent having a stop at the bottom thereof between its rearward and forward ends engageable by said stop-engaging means when the detent is in its lowered position and the slide is pushed in without a coin in said coin-receiving recess to limit the inward movement of the slide;

the upper portion of a coin in the recess being engageable with the detent adjacent the rearward end of the detent when the slide is pushed forward in the body to raise the detent and thereby to raise said stop out of the way of said stop-engaging means to allow the slide to be pushed in to said forward position forward of the limit imposed by said stop.

2. Coin-controlled apparatus as set forth in claim 1 wherein said hole extends through a recess in a housing on said one side of the body, said recess being adapted removably to receive and hold an insert having a keyhole-shaped opening therein for a bar having a cross-section corresponding to the shape of said keyhole-shaped opening.

3. Coin-controlled apparatus as set forth in claim 1 wherein the side walls of the upper part have inside faces with a distance between said inside faces and wherein the detent-receiving recess is narrower than the distance between the inside faces of the side walls of the upper part, said upper part thereby having downwardly facing shoulders on the inside of and at the top of the side walls thereof, wherein said shoulders have downwardly opening recesses adjacent said hole, wherein said detent is pivotally mounted for its said swinging movement by having pin means at its said forward end seated in said recesses, said pin means being held up in said recesses by the slide.

4. Coin-controlled apparatus as set forth in claim 3 wherein the means for limiting the rearward movement of the slide and determining its rearward position comprises means on the slide engageable with means on the inside of the upper and lower parts of the body.

5. Coin-controlled apparatus as set forth in claim 3 wherein the rearward portion of the coin slide is of reduced width thereby having rearwardly facing shoulders at opposite sides thereof forward of the coin-receiving recess, and the sides of the upper and lower parts are formed with inwardly extending flanges at the rearward end thereof providing forwardly facing shoulders at opposite sides of the slideway adjacent its rearward end engageable by the rearwardly facing shoulders on the slide.

6. Coin-controlled apparatus as set forth in claim 3 wherein the upper and lower parts and the detent are molded of plastic, the pin means of the detent comprising pins molded integrally with the detent extending laterally outwardly from opposite sides thereof adjacent the forward end thereof.

7. Coin-controlled apparatus as set forth in claim 3 wherein the slide has an elongate slot in the top thereof, the stop being positioned in said slot when the detent is in said lowered position, the rearward end of said slot constituting said stop-engaging means.

8. Coin-controlled apparatus as set forth in claim 3 wherein the body has a latch housing on the side thereof opposite the side having the hole, said latch housing having a recess therein, and wherein the hole in said one side of the body is formed partly in the side wall of the upper part and partly in the side wall of the lower part at said one side of the body, and wherein said body has a second hole transversely aligned with the first hole extending between the slideway and the recess in said latch housing, said latch housing having a lower part on the outside of the lower part of said body at said other side and an upper part on the outside of the upper part of the body at said other side, the second hole being formed partly in the side wall of the upper part and partly in the side wall of the lower part at said other side of the body;

wherein said latching means comprises a latch for the slide slidable in said recess in the said latch housing and in said second hole between a laterally retracted position clear of the slideway and a slide-latching position extending into and across the slideway, and biased by spring means in the recess in said side housing toward its said slide-latching position;

the forward portion of the slide having a side-to-side elongate slot therein and a tongue for locking the bar in the body extending from the forward end of said side-to-side slot toward but terminating short of the rearward end of the slot to provide a space for passage of the bar therethrough, the bar having a side-to-side hole therein for reception of the locking tongue on sliding out of the slide from its forward to its rearward position, the latch for the slide being movable under its bias to its slide-latching position when the slide is pushed in to its forward position, and when in its slide-latching position extending into said space in the slide and being engageable by the tip of the tongue to latch the slide in its forward position to hold the coin in the slide within the body, the latch being pushed back by the bar on insertion of the bar in the first hole and pushing in the bar to release the slide and allow it to move rearward under its bias to its rearward position for entry of the tongue in the hole in the bar for locking the bar in the body and for returning the coin in the slide.

9. Coin-controlled apparatus as set forth in claim 3 wherein the detent housing has a top and side walls, the top having a rearward generally horizontal portion and a forward inclined portion slanting down toward the forward end of the said upper part of the body.

10. Coin-controlled apparatus as set forth in claim 9 wherein the detent housing has a rearward end wall with a slot extending up from its lower edge for passage of a coin into and out of the body.

11. Coin-controlled apparatus as set forth in claim 10 having a knob at the outer rearward end of the slide, the knob being formed with a web for entry in the slot in the rearward end wall of the detent housing when the slide is pushed in to its forward position.

* * * * *

UNITED STATES PATENT AND TRADEMARK OFFICE

CERTIFICATE OF CORRECTION

PATENT NO. : 5,540,316

DATED : July 30, 1996

INVENTOR(S) : Anthony M. DiPaolo and John T. Hood

It is certified that error appears in the above-indentified patent and that said Letters Patent is hereby corrected as shown below:

Column 9, claim 2, line 26, "apparatus" should read ---mechanism---.

Column 9, claim 3, line 32, "apparatus" should read ---mechanism---.

Column 9, claim 4, line 44, "apparatus" should read ---mechanism---.

Column 9, claim 5, line 49, "apparatus" should read ---mechanism---.

Column 9, claim 6, line 58, "apparatus" should read ---mechanism---.

Column 10, claim 7, line 1, "apparatus" should read ---mechanism---.

Column 10, claim 8, line 6, "apparatus" should read ---mechanism---.

Column 10, claim 9, line 48, "apparatus" should read ---mechanism---.

Column 10, claim 10, line 53, "apparatus" should read ---mechanism---.

Column 10, claim 11, line 57, "apparatus" should read ---mechanism---.

Signed and Sealed this

Fourth Day of March, 1997

*Attest:*

Bruce Lehman

BRUCE LEHMAN

*Attesting Officer*

*Commissioner of Patents and Trademarks*